US007233307B2

(12) United States Patent
Miura et al.

(10) Patent No.: US 7,233,307 B2
(45) Date of Patent: Jun. 19, 2007

(54) DISPLAY CONTROLLER, IMAGE DISPLAY AND METHOD FOR TRANSFERRING CONTROL DATA

(75) Inventors: Susumu Miura, Sapporo (JP); Takahisa Hatano, Sapporo (JP); Hideki Abe, Sapporo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 430 days.

(21) Appl. No.: 10/495,113

(22) PCT Filed: Nov. 14, 2002

(86) PCT No.: PCT/JP02/11902

§ 371 (c)(1),
(2), (4) Date: May 18, 2004

(87) PCT Pub. No.: WO03/044766

PCT Pub. Date: May 30, 2003

(65) Prior Publication Data

US 2004/0263496 A1 Dec. 30, 2004

(30) Foreign Application Priority Data

Nov. 19, 2001 (JP) ..... 2001-352744
Nov. 12, 2002 (JP) ..... 2002-327712

(51) Int. Cl.
*G09G 3/36* (2006.01)

(52) U.S. Cl. ..... 345/100; 345/544; 348/478

(58) Field of Classification Search ..... 345/94, 345/100, 544; 348/473, 476–479
See application file for complete search history.

(56) References Cited

U.S. PATENT DOCUMENTS

| | | | | |
|---|---|---|---|---|
| 5,661,523 | A | 8/1997 | Yamane | |
| 5,699,124 | A * | 12/1997 | Nuber et al. | 348/465 |
| 6,351,289 | B1 * | 2/2002 | Chen et al. | 348/478 |
| 6,573,931 | B1 | 6/2003 | Horii et al. | |
| 6,879,347 | B1 * | 4/2005 | French | 348/473 |

FOREIGN PATENT DOCUMENTS

| | | |
|---|---|---|
| EP | 1111578 | 6/2001 |
| JP | 5-127608 | 5/1993 |
| JP | 10-4516 | 1/1998 |
| JP | 2001-27890 | 1/2001 |
| JP | 2001-92436 | 4/2001 |

OTHER PUBLICATIONS

English language Abstract of JP 5-127608.

* cited by examiner

*Primary Examiner*—Amr A. Awad
*Assistant Examiner*—Steven Holton
(74) *Attorney, Agent, or Firm*—Greenblum & Bernstein, P.L.C.

(57) ABSTRACT

A decoder includes a first bank and a second bank. The first bank is supplied with dynamic control from a microcomputer via a data bus, and the second bank is supplied with static control data from the data bus via the data bus. The dynamic control data or the static control data is read from an address in the bank designated by an address signal. The dynamic control data read from the first bank and second bank is transferred to one of a plurality of registers designated by the address signal.

20 Claims, 10 Drawing Sheets

DISPLAY CONTROLLER, IMAGE DISPLAY AND METHOD FOR TRANSFERRING CONTROL DATA

TECHNICAL FIELD

The present invention relates to a display control device, an image display device and a method for control data transfer.

BACKGROUND ART

Various types of image display devices, such as television receivers or monitoring devices, are commonly used. In the image display device, the contrast, luminance, and the like of an image are initialized when the power is applied thereto. Further, the contrast, luminance, and the like of the image can be set by a user's operation.

In recent years, image display devices which automatically control the contrast, luminance and the like of the image displayed on the screen based on a changing video signal have been developed (refer to, for example, JP 5-127608 A).

In the image display device, the contrast, luminance, and the like are set or controlled by the transfer of control data to a control device for carrying out control operations.

However, the enhancement of the image display performance of the image display device results in an increased amount of control data to be transferred to the control device. The control data is transferred to various signal process means via a storage device; but, increased control data have been conventionally stored in a disorder manner, resulting in a wasteful amount of time for the input/output of control data. This develops a delay in response for operations of controlling the contrast, luminance, and the like unless the control data is efficiently transferred.

DISCLOSURE OF THE INVENTION

An object of the present invention is to provide a display control device which can enhance the image display performance of an image display device by efficient control data transfer.

Another object of the present invention is to provide an image display device having the image display performance thereof enhanced by efficient control data transfer.

Still another object of the present invention is to provide a method for efficiently transferring control data to a control device.

A display control device according to one aspect of the present invention is a display control device for controlling an image display device, comprising a control device that performs a first process for controlling the image display device in a cycle of one frame period while performing a second process for controlling the image display device in a cycle different from one frame period or at an arbitrary timing; a storage device that includes a first storage area and a second storage area; and a processor that writes a first control data for the first process to the first storage area, and writes a second control data for the second process to the second storage area, and that transfers the first control data stored in the first storage area to the control device in a cycle of one frame period, and transfers the second control data stored in the second storage area to the control device in a cycle different from one frame period or at an arbitrary timing.

In the display control device according to the present invention, the control data to be transferred to the control device for controlling the image display device is classified to the first control data for performing the first process and the second control data for performing the second control process. The first control data and second control data is stored in the first storage area and second storage area, respectively, to be transferred to the control device.

In this case, the first control data is stored in the first storage area, whereas the second control data is stored in the second storage area. This avoids non-contiguous addresses during the data transfer to facilitate the control of the addresses, while the data transfer is improved in efficiency, and the image display performance is enhanced.

The processor may transfer, in a frame in which the first control data and the second control data are to be transferred, the first control data stored in the first storage area to the control device, and then transfer the second control data stored in the second storage area to the control device. In this case, the first control data is reliably transferred to the control device within one frame period. Consequently, the first process is reliably performed in a cycle of one frame period.

The processor may distribute the second control data to a plurality of frames for transfer.

In this case, in each of the plurality of frames, the distributed second control data is transferred after the first control data is transferred. Consequently, the first control data is reliably transferred to the control device in each of the frames. Further, the second control data is reliably transferred after the first control data is transferred in the plurality of frames.

The first process may include a process for controlling an image displayed on the screen of the image display device based on a video signal. In this case, the image displayed on the screen of the image display device is controlled in a cycle of one frame period. Consequently, the image can be controlled depending on the changing video signal.

The second process may include a process for initializing the operating state of the image display device when the power is applied thereto. In this case, the second control data for initializing the operating state of the image display device is transferred when the power is applied to the device. Consequently, the operating state of the image display device can be initialized.

The second process may include a process for initializing the operating state of the image display device based on a control signal supplied at an arbitrary timing. In this case, the first control data is transferred in each of the frames, while the second control data for setting the operating state of the image display device at an arbitrary timing is also transferred. Consequently, the image can be controlled depending on the changing video signal, while the operating state of the image display device can be set at an arbitrary timing.

The second process may include a process for setting again the operating state set in the immediately preceding second process in a cycle longer than one frame period. In this case, the second control data for setting again the operating state set in the immediately preceding second process in a predetermined cycle is transferred. This stabilizes the operations of the image display device.

The display control device may further comprise a characteristic amount detecting device that detects the amount of characteristics of an image for one frame based on an input video signal, and the processor may create the first control data based on the amount of characteristics detected by the characteristic amount detecting device to write the first control data to the first storage area.

In this case, the processor can transfer the first control data based on the amount of characteristics of the image for one frame based on the video signal. Consequently, the image can be controlled based on the amount of characteristics of the image for each frame depending on the changing video signal.

The display control device may further comprise a setting unit that sets the operating state of the image display device, and the processor may create the second control data based on the operating state set by the setting unit to write the second control data to the second storage area.

In this case, the first control data is transferred in each of the frames, while the second control data is also transferred based on the operating state set by the setting unit. Consequently, the image can be controlled depending on the changing video signal, while the setting of the image display device can be changed at an arbitrary timing.

The control device may include a plurality of control blocks that perform at least one of the first process and second process, respectively, and the processor may transfer at least one of the first and second control data stored in the first and second storage areas to each of the control blocks.

In this case, at least one of the first and second control data stored in the first and second storage areas is transferred to each of the control blocks. Each of the control blocks can accordingly perform the first and second processes based on the transferred control data.

A display control device according to another aspect of the present invention is an image display device that displays an image, comprising a display device having a screen that displays the image based on a video signal; a control device that performs a first process for controlling the display device in a cycle of one frame period while performing a second process for controlling the display device in a cycle different from one frame period or at an arbitrary timing; a storage device that includes a first storage area and a second storage area; and a processor that writes a first control data for the first process to the first storage area, and writes a second control data for the second process to the second storage area, and that transfers the first control data stored in the first storage area to the control device in a cycle of one frame period, and transfers the second control data stored in the second storage area to the control device in a cycle different from one frame period or at an arbitrary timing.

In the image display device according to the present invention, the control data transferred to the control device is classified to the first control data for performing the first process and the second control data for performing the second process. The first control data and the second control data are stored in the first storage area and second storage area, respectively, to be transferred to the control device. The display device is accordingly controlled by the control device based on the control data.

In this case, the first control data is stored in the first storage area, whereas the second control data is stored in the second storage area. This avoids non-contiguous addresses during the data transfer to facilitate the control of addresses, while the data transfer is improved in efficiency. Consequently, there is no delay in the control operation for displaying the image on the screen of the display device based on the changing video signal, so as to enhance the image display performance and added values of the image display device.

A method for control data transfer according to still another aspect of the present invention is a method for transferring control data to a control device for controlling an image display device, comprising the steps of writing a first control data for a first process for controlling the image display device in a cycle of one frame period to a first storage area; writing a second control data for a second process for controlling the image display device in a cycle different from one frame period or at an arbitrary timing to a second storage area; transferring the first control data stored in the first storage area to the control device in a cycle of one frame period; and transferring the second control data stored in the second storage area to the control device in a cycle different from one frame period or at an arbitrary timing.

In the method for control data transfer according to the present invention, the first control data is written to the first storage area, whereas the second control data is written to the second storage area. The first control data written to the first storage area is transferred to the control device in a cycle of one frame period, whereas the second control data written to the second storage area is transferred to the control device in a cycle different from one frame period or at an arbitrary timing. This avoids non-contiguous addresses during the data transfer to facilitate the control of addresses, while the data transfer is improved in efficiency.

In the display control device according to the present invention, only the first control data is stored in the first storage area, and only the second control data is stored in the second control area. This avoids non-contiguous addresses during the data transfer to facilitate the control of addresses, while the data transfer is improved in efficiency.

BEST MODE FOR CARRYING OUT THE INVENTION

First Embodiment

Figure 1:
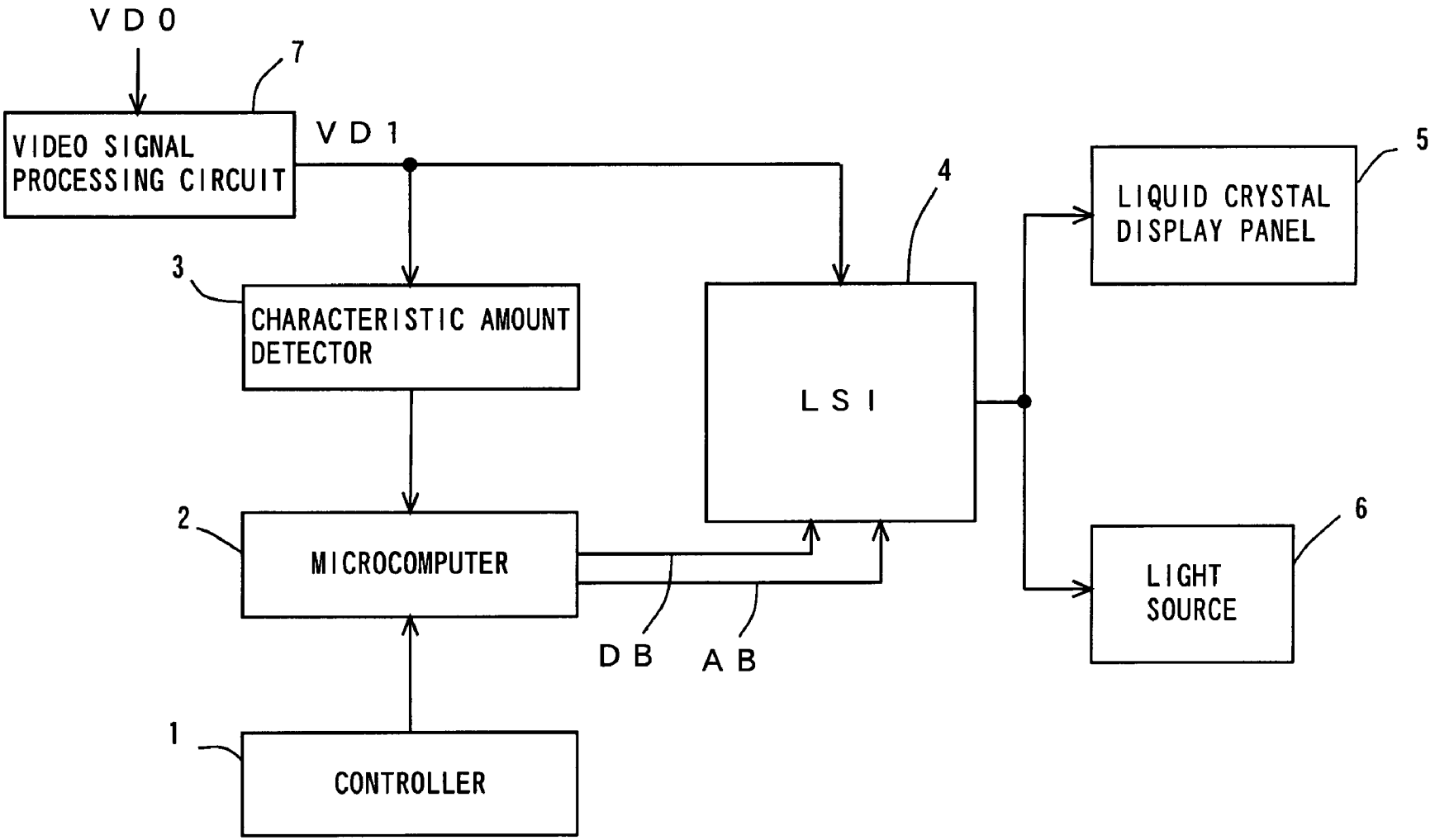
FIG. 1 is a block diagram illustrating the configuration of an image display device.

FIG. 1 is a block diagram illustrating the configuration of an image display device according to a first embodiment of the present invention. The image display device according to the present embodiment is a television receiver or a monitoring device using a liquid crystal display panel.

The image display device comprises a controller 1, a microcomputer 2, characteristic amount detector 3, an LSI 4, a liquid crystal display panel 5, a light source 6, and a video signal processing circuit 7.

The video signal processing circuit 7 processes a video signal VD0 in a predetermined manner to supply a processed video signal VD1 to the characteristic amount detector 3 and the LSI 4. The characteristic amount detector 3 detects the amount of characteristics of an image based on the video signal VD1, and supplies the detected amount of characteristics to the microcomputer 2. The amount of characteristics as used herein represents, for example, a maximum luminance, minimum luminance, average luminance, and the like.

A user can set the operating states of the image display device with the controller 1. The operating states as used herein represent the contrast, luminance, aspect ratio, resolution, pixel number, and the like of an image.

The controller 1 supplies a control signal representing the operating states set by the user to the microcomputer 2.

The microcomputer 2 supplies the LSI 4 with control data for controlling dynamic processes as described later via a data bus DB based on the amount of characteristics supplied by the characteristic amount detector 3. Further, the microcomputer 2 supplies the LSI 4 with static control data for controlling static processes and refresh processes as described later via the data bus DB. The microcomputer 2 also supplies via an address bus AB to the LSI 4 an address signal for designating addresses at which the dynamic control data and static control data are stored.

The LSI 4 controls the liquid crystal display panel 5 and the light source 6 based on the video signal VD1 supplied by the video signal processing circuit 7 and the dynamic control data and static control data supplied by the microcomputer 2. Detailed description will later be made of the configuration and operation of the LSI 4.

The process for controlling the image display device in a cycle of one frame period based on a video signal will, hereinafter, be referred to as a dynamic process; the process for initializing the operating states of the image display device when the power is applied thereto and the process for setting the operating states of the image display device based on the control signal supplied at an arbitrary timing, will be referred to as a static process; and the process for setting again the operating states set by the immediately preceding static process in a predetermined cycle longer than one frame period, will be referred to as a refresh process.

Control data for controlling the dynamic process will be referred to as dynamic control data, and control data for controlling the static process and refresh process will be referred to as static control data.

The dynamic process includes, for example, a process for controlling the image contrast based on the maximum luminance and minimum luminance of the image for one frame, and a process for controlling the luminance of the light source 6 based on the average luminance of the image for one frame.

The static process includes, for example, a process for initializing the contrast, luminance, aspect ratio, resolution, pixel number, and the like of an image when the power is applied, and a process for setting the contrast, luminance, aspect ratio, resolution, pixel number, or the like of the image at an arbitrary timing based on the user operation.

The refresh process includes, for example, a process for setting again the operating states set in the immediately preceding static process to stabilize the operations of the image display device at every several seconds.

Figure 2:
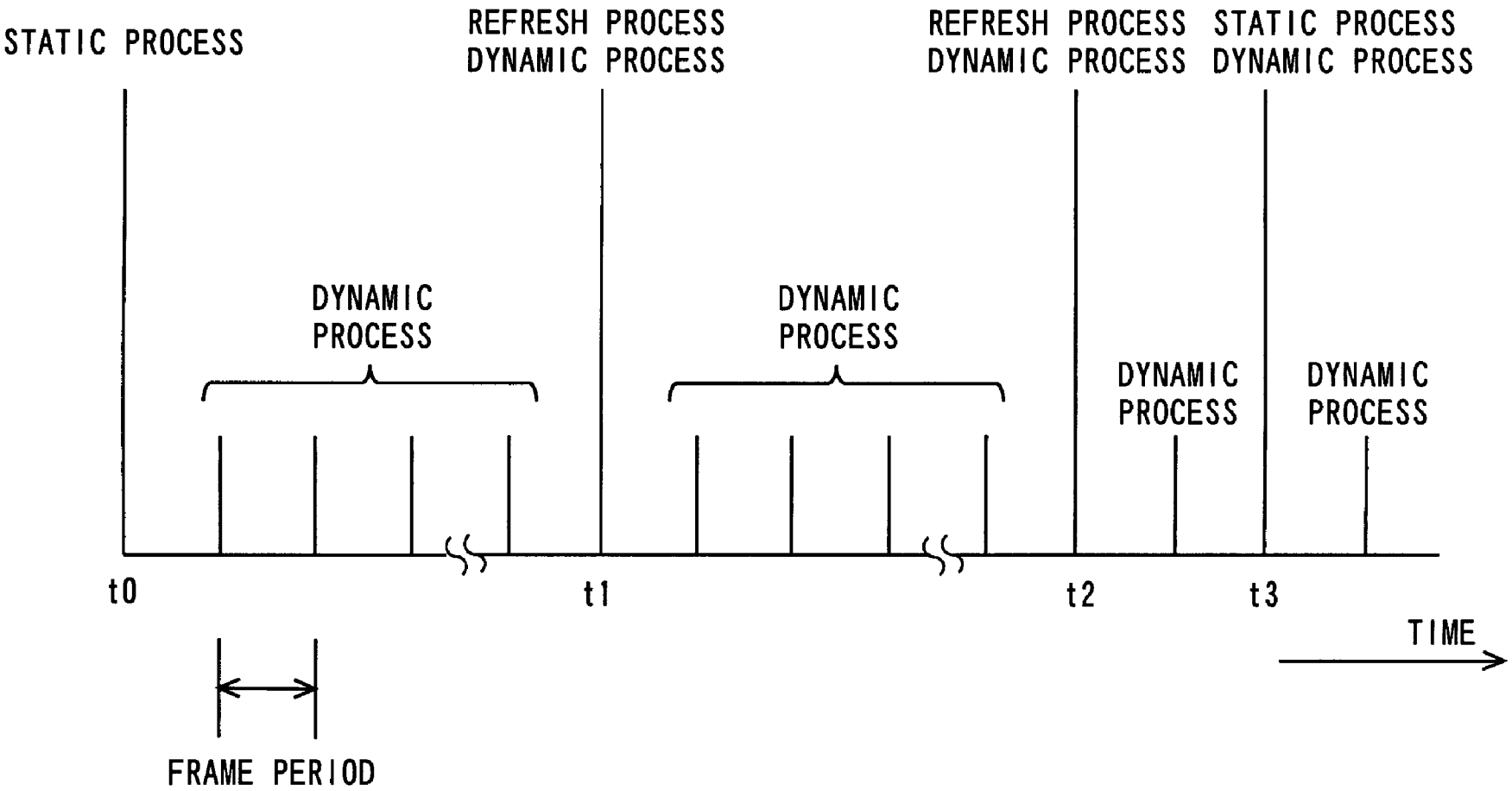
FIG. 2 is a diagram for use in illustrating the periods at which dynamic processes, static processes, and refresh processes occur.

FIG. 2 is a diagram for use in illustrating the periods at which dynamic processes, static processes, and refresh processes occur. The abscissa represents time.

At time point t0, the image display device is turned on. This causes a static process for initializing the operating states of the liquid crystal display panel 5, light source 6, and the like shown in FIG. 1.

After the image display device is turned on, a dynamic process is repeated for each frame in response to a changing video signal VD1. One frame period is, for example, about several p seconds.

When several seconds have passed while dynamic processes have been repeated, at time point t1, a dynamic process and a refresh process occur. The refresh process is a process for setting again the operating states set in the immediately preceding static process in order to stabilize the operations of the liquid crystal display panel 5 and light source 6 shown in FIG. 1. Accordingly, in the refresh process at the time point t1, the operating states initialized when the image display device is turned on at the time point t0 is set again.

Similarly, also at time point t2, a dynamic process and a refresh process occur.

Thereafter, a dynamic process occurs for each frame, and a refresh process occurs at every several seconds.

Here, at time point t3, the user changes the settings of the operating states by operating the controller 1, so that a static process for changing the settings of the operating states of the liquid crystal display panel 5, light source 6, or the like shown in FIG. 1 occurs. A dynamic process also occurs at the same time.

In this case, in a succeeding refresh process, the operating states changed by the user operating the controller 1 is set again.

Figure 3:
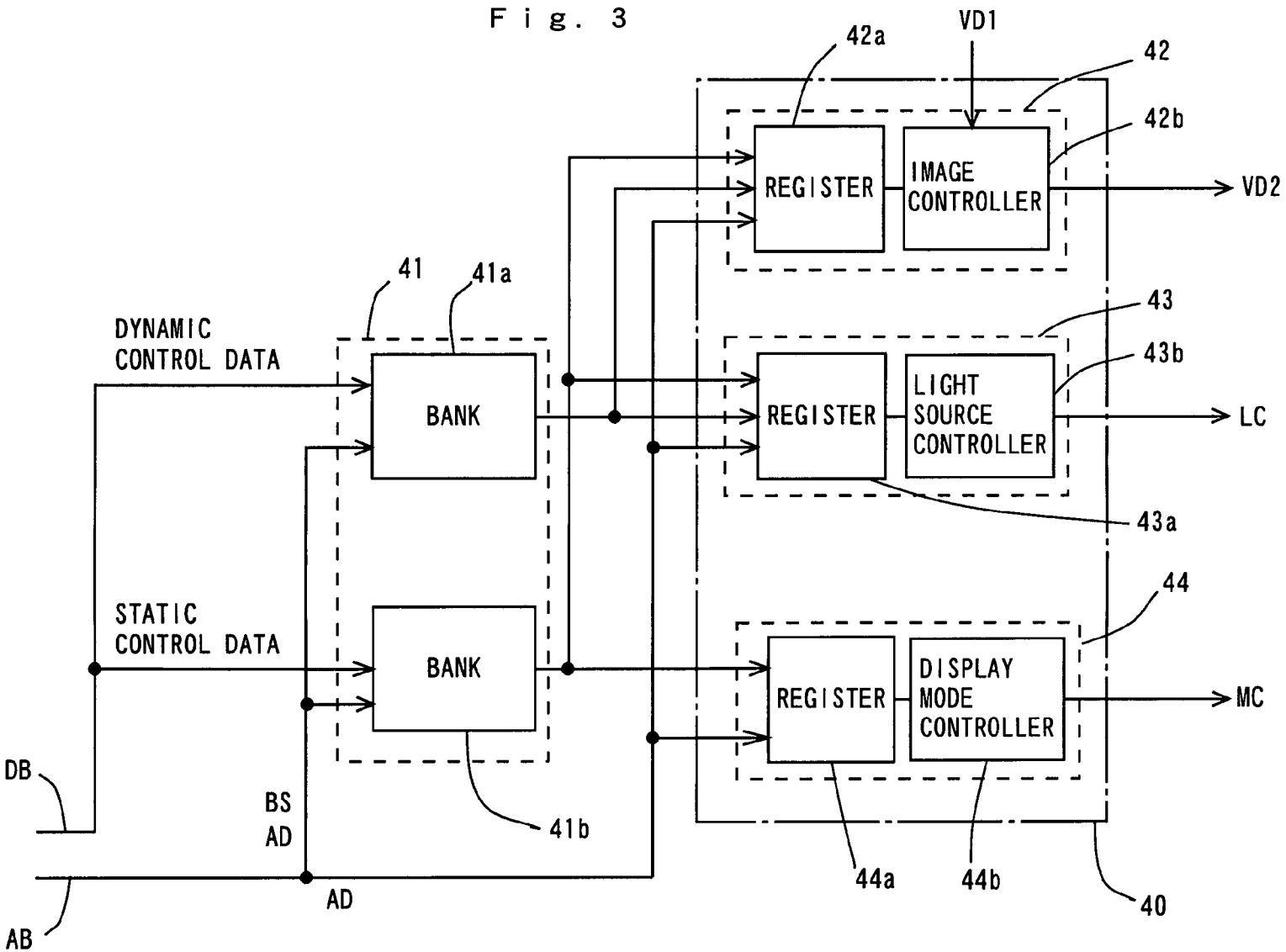
FIG. 3 is a block diagram illustrating the configuration of an LSI.
Figure 4:
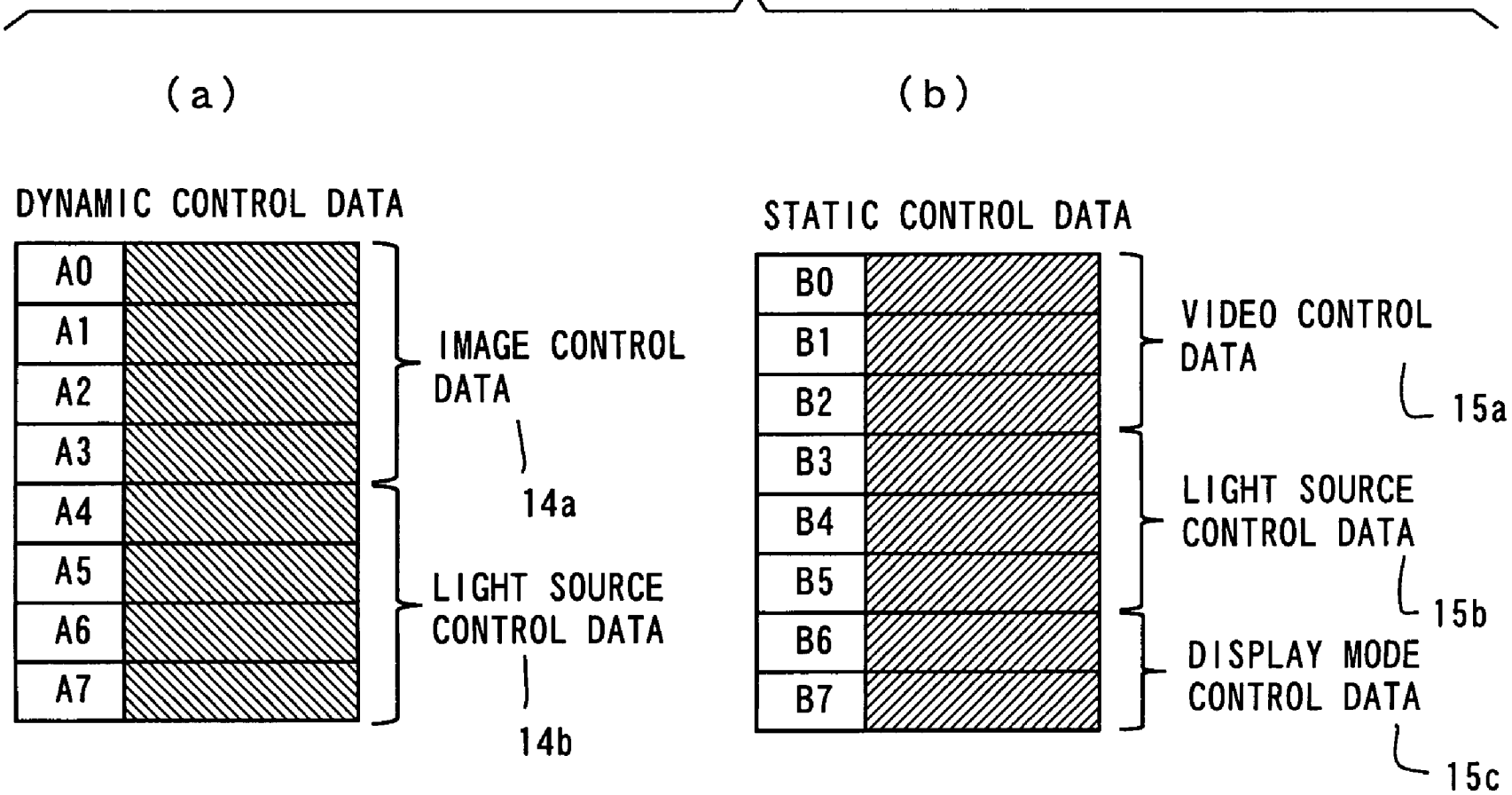
FIG. 4 is a diagram illustrating one example of the dynamic control data stored in a bank and one example of the static control data stored in a bank.
Figure 5:
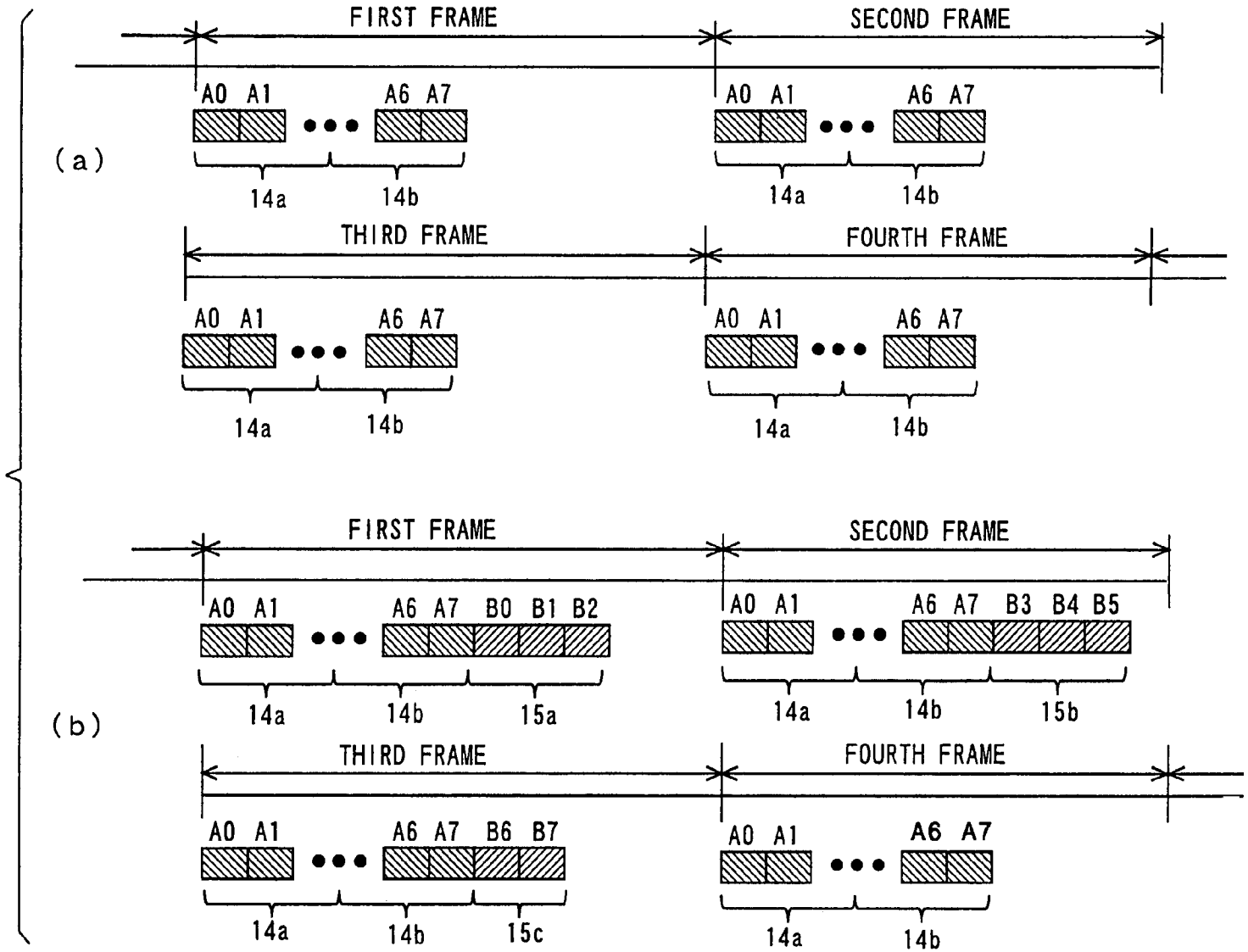
FIG. 5 is a diagram for use in illustrating the transfer of the dynamic control data and static control data to registers.

Referring now to FIGS. 3 to 5, detailed description will be provided of the data transfer inside the LSI 4 shown in FIG. 1 when a dynamic process, a static process, and a refresh process occur.

FIG. 3 is a block diagram illustrating the configuration of the LSI 4. The LIS 4 as shown in FIG. 3 includes a decoder 41 and a control device 40. The control device 40 includes an image control block 42, a light source control block 43, and a display mode control block 44.

The decoder 41 is composed of a storage device such as a RAM (Random Access Memory), and includes a bank 41*a* and a bank 41*b*. Note that the control device 40 in fact includes various control blocks in addition to the image control block 42, light source control block 43, and display mode control block 44; however, for easier understanding, only the above image control block 42, light source control block 43, and display mode control block 44 are herein shown.

The image control block 42 includes a register 42*a* and an image controller 42*b*; the light source control block 43 includes a register 43*a* and a light source controller 43*b*; and the display mode control block 44 includes a register 44*a* and a display mode controller 44*b*.

The bank 41*a* is supplied with the dynamic control data from the microcomputer 2 via the data bus DB, whereas the bank 41*b* is supplied with the static control data from the microcomputer 2 via the data bus DB. Further, the banks 41*a*, 41*b* are supplied with an address signal AD and a bank selection signal BS from the microcomputer 2 via the address bus AB, whereas the registers 42*a*, 43*a*, 44*a* are supplied with an address signal AD from the microcomputer 2 via the address bus AB.

At the time of writing the dynamic control data, the microcomputer 2 outputs the dynamic control data to the data bus DB, and selects the bank 41*a* based on the bank selection signal BS while designating an address based on the address signal AD. This results in writing the dynamic control data on the data bus DB to the address in the bank 41*a* designated by the address signal AD.

At the time of writing the static control data, the microcomputer 2 outputs the static control data to the data bus DB, and selects the bank 41*b* based on the bank selection signal BS while designating an address based on the address signal AD. This results in writing the static control data on the data bus DB to the address in the bank 41*b* designated by the address signal AD.

At the time of reading the dynamic control data, the microcomputer 2 selects the bank 41*a* based on the bank selection signal BS while designating an address based on the address signal AD. This results in reading the dynamic control data from the address in the bank 41*a* designated by the address signal AD. The dynamic control data read from the bank 41*a* is transferred to one of the registers 42*a*, 43*a* designated by the address signal AD.

At the time of reading the static control data, the microcomputer 2 selects the bank 41*b* based on the bank selection signal BS while designating an address based on the address signal AD. This results in reading static control data from the address in the bank 41*b* designated by the address signal AD. The static control data read from the bank 41*b* is transferred to one of the registers 42*a*, 43*a*, 44*a* designated by the address signal AD.

The register 42*a* holds the dynamic control data transferred from the bank 41*a* and the static control data transferred from the bank 41*b*. The image controller 42*b* corrects the video signal VD1 supplied by the video signal processing circuit 7 based on the dynamic control data and the static control data held in the register 42*a*, and supplies a corrected video signal VD2 to the liquid crystal display panel 5.

In this example, the register 42*a* holds the dynamic control data or the static control data for controlling the image contrast. This allows the image controller 42*b* to correct the contrast of the video signal VD1 based on the dynamic control data and static control data, and supply the corrected video signal VD2 to the liquid crystal display panel 5.

The register 43*a* holds the dynamic control data transferred from the bank 41*a* and the static control data transferred from the bank 41*b*. The light source controller 43*b* supplies the light source with luminance control data LC based on the dynamic control data and static control data held in the register 43*a*.

In this example, the register 43*a* holds the dynamic control data and static control data for controlling the luminance of the image. This allows the light source controller 43*b* to supply the light source 6 with luminance control data LC for controlling the luminance of the light source 6 based on the dynamic control data and static control data.

The register 44*a* holds the static control data transferred from the bank 41*b*. The display mode controller 44*b* supplies a display mode setting signal MC to the liquid crystal display panel 5 based on the static control data held in the register 44*a*.

In this example, the register 44*a* holds the static control data for setting the display modes of the aspect ratio, pixel number, resolution, and the like of the image. This allows the display mode controller 44*b* to supply the display mode setting signal MC for setting the display modes to the liquid crystal display panel 5 based on the static control data.

FIG. 4(*a*) is a diagram illustrating one example of the dynamic control data stored in the bank 41*a*; and FIG. 4(*b*) is a diagram illustrating one example of the static control data stored in the bank 41*b*.

For simplicity of explanation, it is assumed here that the bank 41*a* has addresses A0 to A7, and the bank 41*b* has addresses B0 to B7. The bank 41*a* stores, as dynamic control data, image control data 14*a* such as gain information or offset information, and light source control data 14*b* such as luminance adjustment value data, which change for each frame. On the other hand, the bank 41*b* stores, as static control data, information which does not frequently change, i.e., image control data 15*a* such as peaking gain information and peaking frequency information; light source control data 15*b* such as inverter PWM (pulse width modulation) frequency information of the light source 6; and display mode control data 15*c* such as information for the resolution of the liquid crystal display panel 5 and for the selection of a screen mode.

The image control data 14*a* is written to the addresses A0 to A3 in the bank 41*a*. The light source control data 14*b* is written to the addresses A4 to A7 in the bank 41*a*.

Further, the image control data 15*a* is written to the addresses B0 to B2 in the bank 41*b*. The light source control data 15*b* is written to the addresses B3 to B5 in the bank 41*b*. The display mode setting data 15*c* is written to the addresses B6, B7 in the bank 41*b*.

The dynamic process will now be described with reference to FIGS. 3 to 5.

FIG. 5(*a*) is a diagram for use in illustrating the transfer of dynamic control data to registers when a dynamic process occurs; and FIG. 5(*b*) is a diagram for use in illustrating the transfer of static control data and dynamic control data to registers when a static process or refresh process occurs.

In FIG. 5, the shaded blocks each represent the dynamic control data or static control data with the symbols A0 to A7, B0 to B7 above the respective blocks representing the addresses in the banks 41*a*, 41*b* from which the dynamic control data or static control data is read.

When a dynamic process is performed, in the first frame shown in FIG. 5(*a*), the microcomputer 2 selects the bank 41*a* based on the bank selection signal BS, and sequentially designates the addresses A0 to A3 based on the address'signal AD while selecting the register 42*a*, and selects the bank 41*a* based on the bank selection signal BS, and sequentially designates the addresses A4 to A7 based on the address signal AD while selecting the register 43*a*. This allows the image control data 14*a* stored in the addresses A0 to A3 in the bank 41*a* to be sequentially transferred to the register 42*a*, as well as the light source control data 14*b* stored in the addresses A4 to A7 in the bank 41*a* to be sequentially transferred to the register 43*a*.

Similarly in the second frame, third frame, fourth frame, and other frames, the image control data 14*a* and light source control data 14*b* stored in the addresses A0 to A7 in the bank 41*a* are sequentially transferred to the register 42*a* and image control block 42*b*.

As shown in FIG. 5(*a*), in the dynamic process, the transfer of dynamic control data stored in the addresses A0 to A7 in the bank 41*a* is accomplished for each frame.

The static process and refresh process will now be explained with reference to FIGS. 3 to 5.

When a static process or refresh process occurs, the static control data is divided into a plurality of frames for transfer. Description will, hereinafter, be made of a case where the static control data is divided into three frames for transfer as shown in FIG. 5(*b*).

In the first frame shown in FIG. 5(*b*), the microcomputer 2 selects the bank 41*a* based on the bank selection signal BS, and sequentially designates the addresses A0 to A3 based on the address signal AD while selecting the register 42*a*, and selects the bank 41*a* based on the bank selection signal BS, and sequentially designates the addresses A4 to A7 based on the address signal AD while selecting the register 43*a*, and selects the bank 41*b* based on the bank selection signal BS, and designates the addresses B0 to B2 based on the address signal AD while selecting the register 42*a*. This allows the image control data 14*a* stored in the addresses A0 to A3 in the bank 41*a* to be sequentially transferred to the register 42*a*, and the light source control data 14*b* stored in the addresses A4 to A7 in the bank 41*a* to be sequentially transferred to the register 43*a*, and the image control data 15*a* stored in the addresses B0 to B2 in the bank 41*b* to be sequentially transferred to the register 42*a*.

In the subsequent second frame shown in FIG. 5(*b*), the microcomputer 2 sequentially transfers the image control data 14*a* stored in the addresses A0 to A3 in the bank 41*a* to the register 42*a*, and sequentially transfers the light source control data 14*b* stored in the addresses A4 to A7 in the bank 41*a* to the register 43*a*, and sequentially transfers the light source control data 15*b* stored in the addresses B3 to B5 in the bank 41*b* to the register 43*a*, similarly as in the first frame.

Further, in the third frame shown in FIG. 5(*b*), the microcomputer 2 sequentially transfers the image control data 14*a* stored in the addresses A0 to A3 in the bank 41*a* to the register 42*a*, and sequentially transfers the light source control data 14*b* stored in the addresses A4 to A7 in the bank 41*a* to the register 43*a*, and sequentially transfers the display mode control data 15*c* stored in the addresses B6, B7 in the bank 41*b* to the register 44*a*, similarly as in the first frame.

In the fourth frame and thereafter, the dynamic process as shown in FIG. 5(*a*) is repeated until a static process or a refresh process occurs.

In such a manner, the static control data is divided into three frames for transfer, so that the static process or refresh process is accomplished in three frames.

Figure 6:
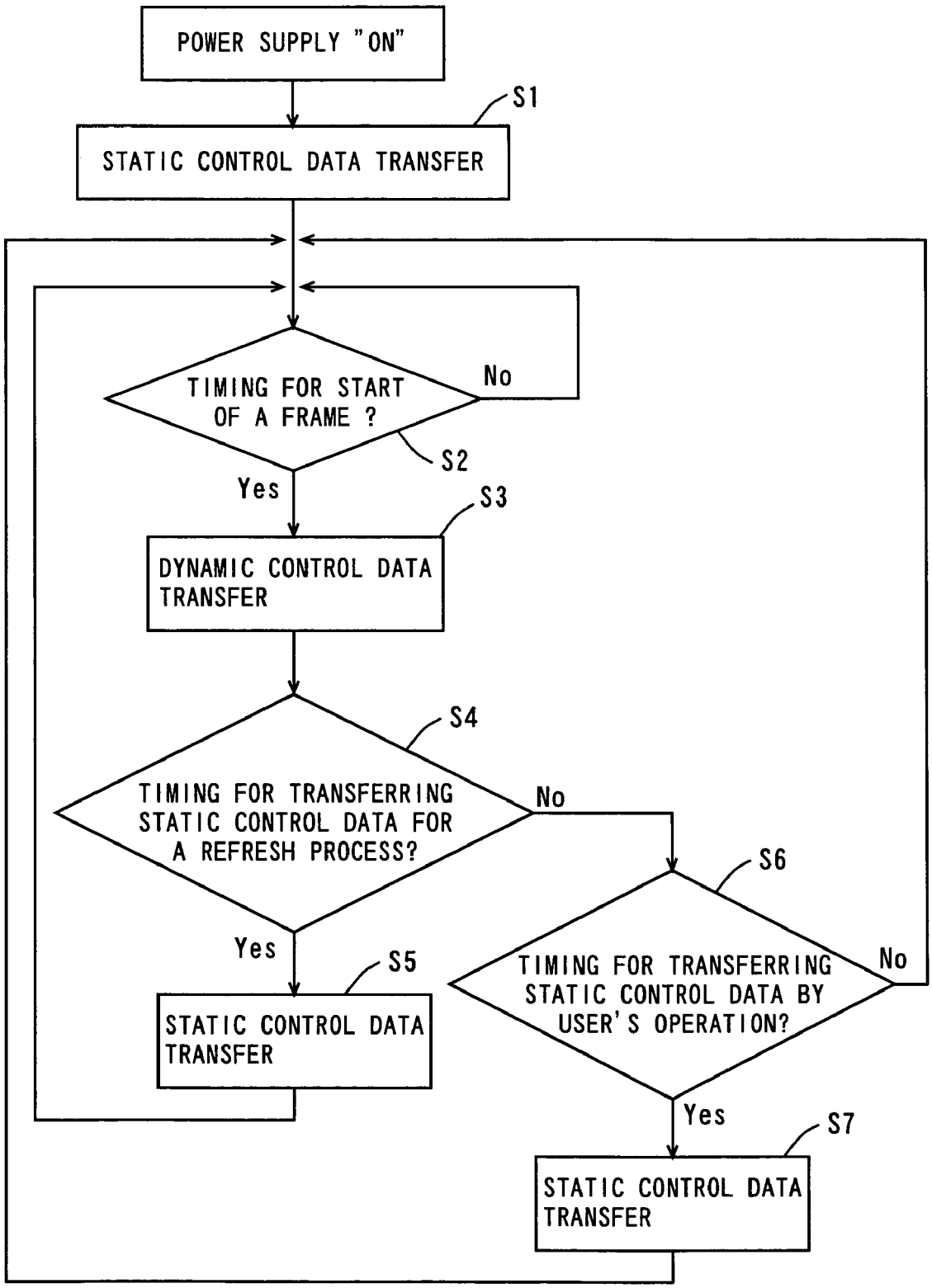
FIG. 6 is a flow chart illustrating the transfer of the dynamic control data and static control data which is controlled by a microcomputer.

FIG. 6 is a flow chart illustrating the transfer of the dynamic control data and static control data which is controlled by the microcomputer 2.

When the image display device is turned on, the microcomputer 2 transfers the static control data from the bank 41*b* to the registers 42*a*, 43*a*, 44*a* (Step S1).

The microcomputer 2 then determines whether or not it is the timing for the start of a frame (Step S2). At the timing for the start of the frame, the microcomputer 2 transfers the dynamic control data from the bank 41*a* to the registers 42*a*, 43*a* (Step S3).

The microcomputer 2 then determines whether or not it is the timing for transferring the static control data for a refresh process (Step S4).

Here, the timing for transferring the static control data for the refresh process is set at a time point where the transfer of the dynamic control data is accomplished. Where the static control data is divided into a plurality of frames for transfer, the timing for transferring the static control data is set at a time point where the transfer of the dynamic control data is accomplished in each of the frames.

At the timing for transferring the static control data, the microcomputer 2 transfers the static control data from the bank 41*b* to the registers 42*a*, 43*a*, 44*a* (Step S5), and returns to the operation of Step S2.

At Step S4, where it is not the timing for transferring the static control data for the refresh process, the microcomputer 2 determines whether or not it is the timing for transferring the static control data by the user's operation (Step S6).

Here, the timing for transferring the static control data by the user's operation is set at a time point where the transfer of the dynamic control data is accomplished after the user's operation with the controller 1 shown in FIG. 1. Where the static control data is divided into a plurality of frames for transfer, the timing for transferring the static control data is set at a time point where the transfer of the dynamic control data is accomplished in each of the frames.

At the timing for transferring the static control data, the microcomputer 2 transfers the static control data from the bank 41*b* to the registers 42*a*, 43*a*, 44*a* (Step S7), and returns to the operation of Step S2.

At Step S6, where it is not the timing for transferring the static control data by the user's operation, the microcomputer 2 returns to the operation of Step S2.

As described in the above, in the image display device according to the present embodiment, the dynamic control data is stored in the bank 41*a*, the static control data is stored in the bank 41*b*, the dynamic control data is transferred from the bank 41*a* to the control device 40, and the static control data is transferred from the bank 41*b* to the control device 40. This avoids non-contiguous addresses during the data transfer to facilitate the control of addresses, while the data transfer is enhanced in efficiency. Consequently, a large amount of dynamic control data and static control data can be transferred efficiently. As a result, there is no delay in response for the control operations in the image display device, resulting in enhanced image display performance and increased added values of the image display device.

Moreover, the dynamic control data is transferred in each frame, and the static control data is transferred during the static process or the refresh process. Consequently, it is possible to reliably transfer the dynamic control data for the dynamic process to be accomplished for each frame within one frame period. It is also possible to reliably transfer, after the dynamic control data is transferred in one or a plurality of frames, the static control data for the static process or refresh process which are not required to be accomplished within each frame.

Second Embodiment

Figure 7:
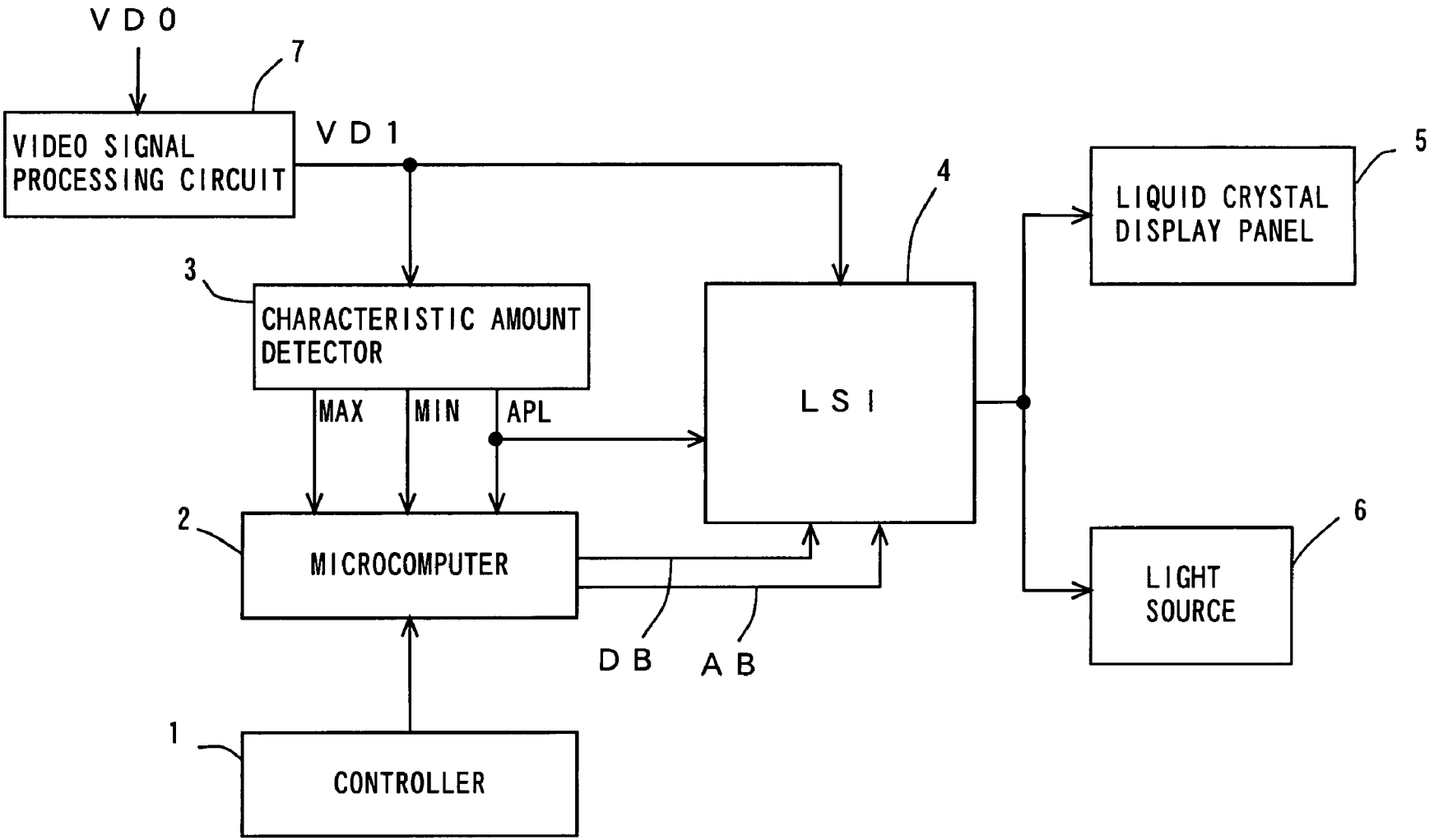
FIG. 7 is a block diagram illustrating the configuration of an image display device according to a second embodiment of the present invention.

FIG. 7 is a block diagram illustrating the configuration of an image display device according to a second embodiment of the present invention. The image display device as shown in FIG. 7 differs from the image display device as shown in FIG. 1 in the operations of a characteristic amount detector 3, a microcomputer 2, and an LSI 4, and the configuration of the LSI 4.

The characteristic amount detector 3 detects a maximum luminance level MAX, a minimum luminance level MIN, and an average luminance level APL of a video signal VD1 for each frame. The characteristic amount detector 3 supplies the microcomputer 2 with the maximum luminance level MAX and minimum luminance level MIN of the video signal VD1, and supplies the microcomputer 2 and LSI 4 with the average luminance level APL of the video signal VD1.

Detailed description will, hereinafter, be made of the operations of the microcomputer 2 and LSI 4.

Figure 8:
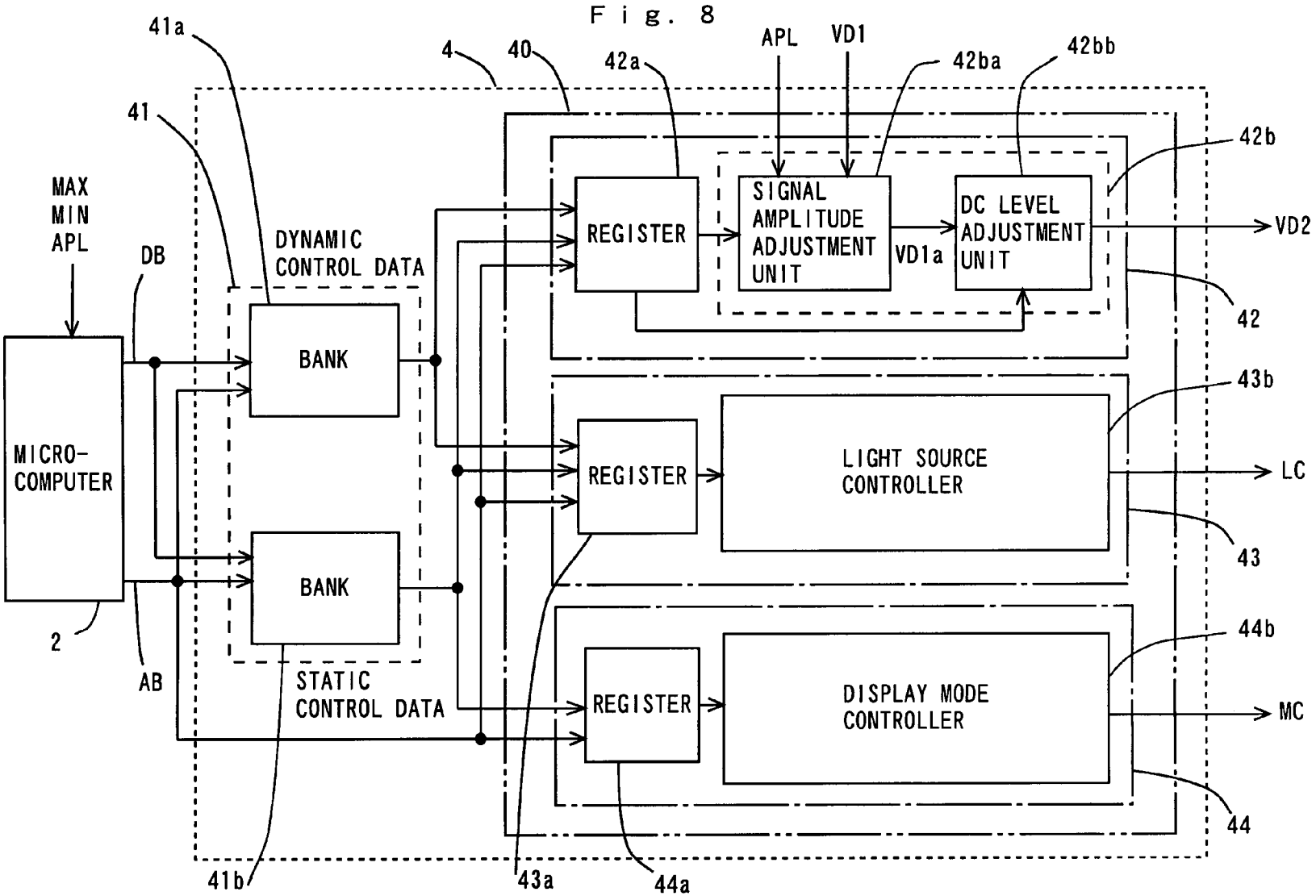
FIG. 8 is a block diagram illustrating the configuration of an LSI.

FIG. 8 is a block diagram illustrating the configuration of the LSI 4 shown in FIG. 7.

In the present embodiment, an image controller 42*b* includes a signal amplitude adjustment unit 42*ba* and a DC level adjustment unit 42*bb*. The video signal VD1 and the average luminance level APL are supplied to the signal amplitude adjustment unit 42*ba*.

Figure 9:
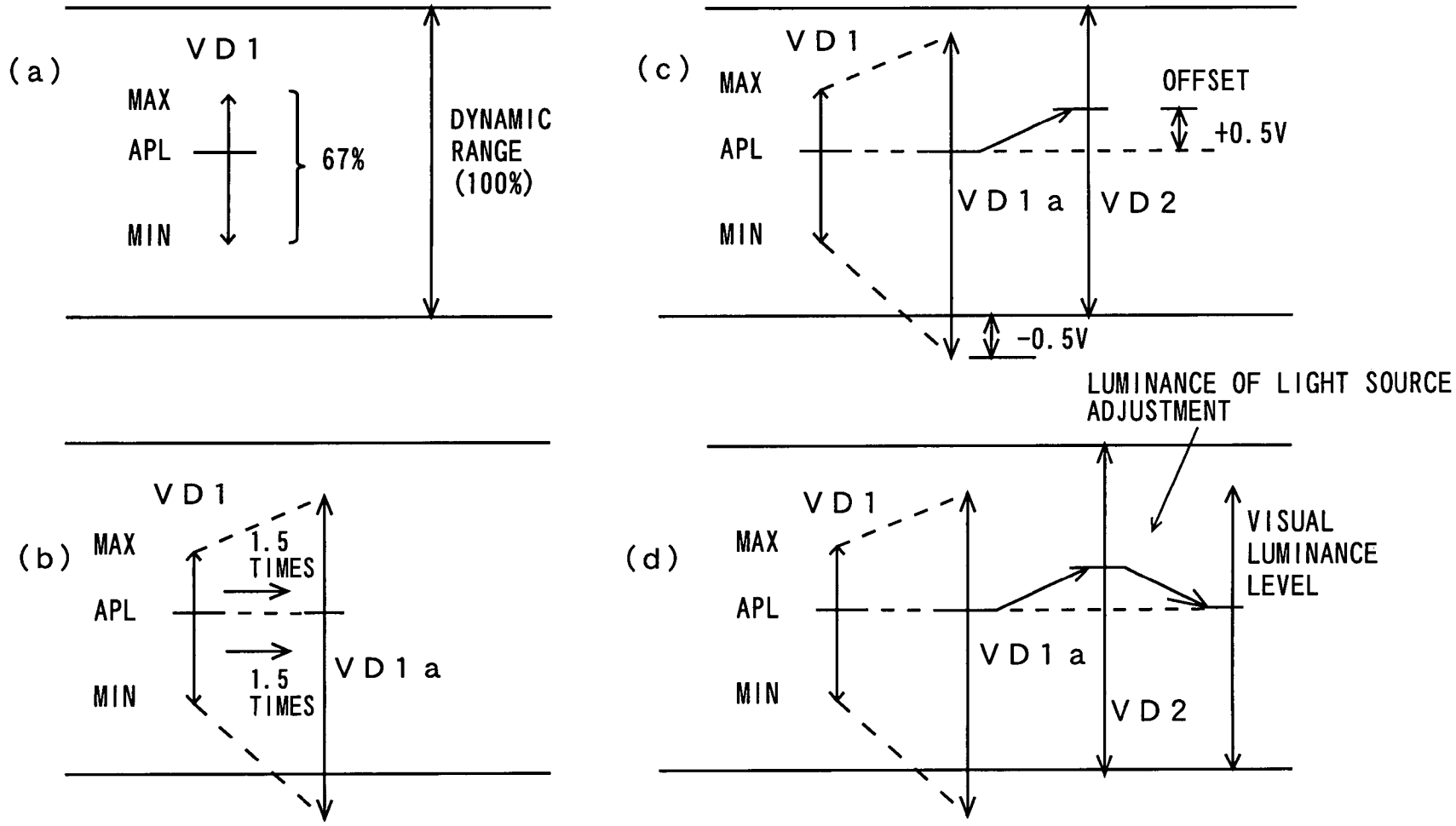
FIG. 9 is a diagram for use in illustrating an example of summarized dynamic process which is undergone by a certain video signal.
Figure 10:
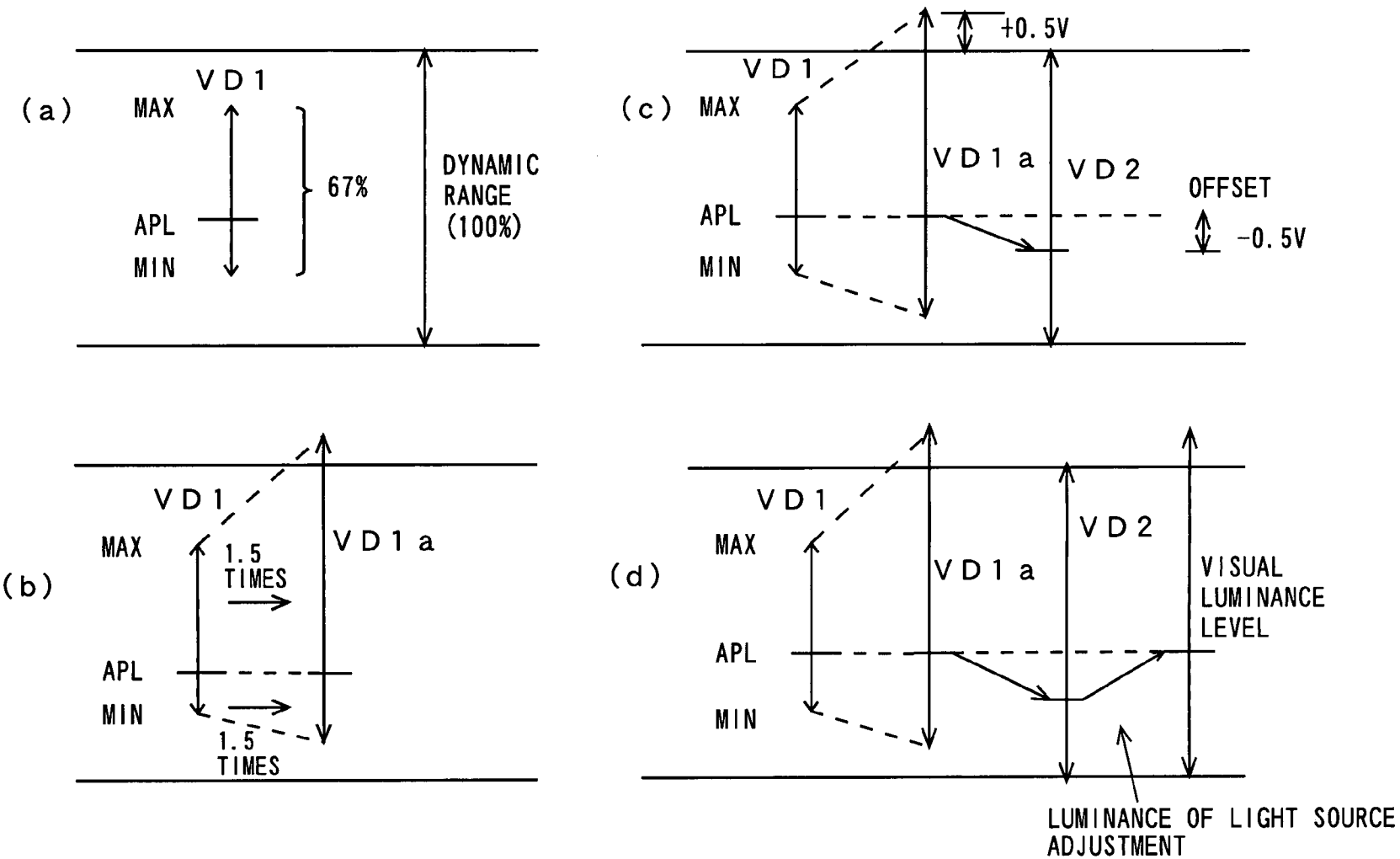
FIG. 10 is a diagram for use in illustrating an example of summarized dynamic process which is undergone by a certain input video signal.

Referring now to FIGS. 9 and 10, description will be provided of one example of dynamic process in the image display device according to the second embodiment. Note that the static process in the image display device according to the second embodiment is the same as the static process in the image display device according to the first embodiment.

Similarly as in the first embodiment, dynamic control data is supplied to a bank 41*a* from the microcomputer 2 via a data bus DB, whereas static control data is supplied to a bank 41*b* from the microcomputer 2 via the data bus DB. An address signal AD and a bank selection signal BS are supplied to the banks 41*a*, 41*b* from the microcomputer 2 via an address bus AB, and an address signal AD is supplied to registers 42*a*, 43*a*, 44*a* from the microcomputer 2 via the address bus AB.

The operations of writing the dynamic control data to the bank 41*a*, writing the static control data to the bank 41*b*, transferring the dynamic control data from the bank 41*a* to the registers 42*a*, 43*a*, and transferring the static control data from the bank 41*b* to the registers 42*a*, 43*a*, 44*a* are the same as those in the first embodiment.

Also, the dynamic control data and static control data are transferred in the same manner as described using FIG. 5.

FIGS. 9 and 10 are each diagrams for use in illustrating an example of summarized dynamic process which is carried out on a certain video signal.

The microcomputer 2 finds a gain for the adjustment of signal amplitude (hereinafter abbreviated to a gain) and an amount of DC level shift of the video signal (hereinafter referred to as offset), based on the maximum luminance level MAX, minimum luminance level MIN, and average luminance level APL supplied from the characteristic amount detector 3, as in the following manner.

Now, a case where the characteristic amount detector 3 detects the maximum luminance levels MAX, minimum luminance levels MIN, and average luminance levels APL as shown in FIG. 9(*a*) and FIG. 10(*a*), will be examined.

Initially, the microcomputer 2 finds a gain for amplifying a difference between the maximum luminance level MAX and the minimum luminance level MIN (hereinafter referred to as a maximum amplitude) to a dynamic range (the range where signal processing is allowed) of the image controller 42*b* in accordance with the following equation:

$$\text{gain}=\text{dynamic range}/\text{maximum amplitude}$$

For example, as shown in FIG. 9(*a*), where the maximum amplitude of the video signal VD1 is 67% for the dynamic range, the microcomputer 2 finds a gain of about 1.5.

The microcomputer 2 supplies the found gain as dynamic control data to the signal amplitude adjustment unit 42*ba* via the bank 41*a* and register 42*a*. As shown in FIG. 9(*a*) and FIG. 10(*b*), the signal amplitude adjustment unit 42*ba* amplifies the video signal VD1, based on the gain supplied from the microcomputer 2 and the average luminance level APL from the characteristic amount detector 3, supplying the amplified video signal VD1 as a video signal VD1*a* to the DC level adjustment unit 42*bb*.

Since the video signal VD1*a* is amplified using the average luminance level APL as a reference, the video signal VD1*a* does not necessarily fall within the dynamic range. For example, a minus symbol is given to the portion of signal being lower than the lower limit of the dynamic range, as shown in FIG. 9(*b*). On the other hand, a plus symbol is given to the portion of signal being higher than the upper limit of the dynamic range, as shown in FIG. 10(*b*). The microcomputer 2 accordingly finds an offset for providing the DC level shift in such an amount that the video signal VD1*a* falls within the dynamic range.

For example, when the amplitude of the video signal VD1*a* is lower than the lower limit of the dynamic range by 0.5 V as shown in FIG. 9(*c*), the microcomputer finds an offset of +0.5 V. On the other hand, when the amplitude of the video signal VD1*a* is higher than the upper limit of the dynamic range by 0.5 V, the microcomputer 2 finds an offset of −0.5 V. The microcomputer 2 supplies the found offset as dynamic control data to the DC level adjustment unit 42*bb* via the bank 41*a* and register 42*a*, as well as to the light source controller 43*b* via the bank 41*a* and register 43*a*.

The DC level adjustment unit 42*bb* is supplied with the video signal VD1*a* supplied from the signal amplitude adjustment unit 42*ba*, and the offset supplied from the microcomputer 2 via the bank 41*a* and register 42*a*. The DC level adjustment unit 42*bb* then shifts the DC level of the supplied video signal DV1*a* by the amount of offset, as shown in FIGS. 9(*c*) or 10(*c*), and supplies a resulting video signal VD2 to the liquid crystal display panel 5. The video signal VD2 is displayed as an image on the liquid crystal display panel 5.

In order to equalize the visual luminance level of the video signal VD2 with the luminance level of the video signal VD1 based on the supplied offset from the microcomputer 2, the light source controller 43*b* makes a predetermined adjustment for the luminance of the light source 6 so as to equalize the average luminance level APL when the image is displayed on the liquid crystal display panel 5 with the average luminance level APL of the video signal VD1, as shown in FIG. 9(*d*) or FIG. 10(*d*). In such a manner, the light source adjustment unit 6 corrects the variation of the average luminance level APL caused by the DC level adjustment unit 42*bb*.

Consequently, in the example of FIG. 9(*d*), the luminance of the light source 6 is decreased, resulting in an average of the visual luminance level being corresponding to the average luminance level APL of the video signal VD1. As a result, the contrast and luminance of an image are properly controlled.

Further, in the example of FIG. 10(*d*), the luminance of the light source 6 is increased, resulting in an average of the visual luminance level being corresponding to the average luminance level APL of the video signal VD1. As a result, the contrast and luminance of an image are properly controlled.

As described in the above, in the image display device according to the present embodiment also, the dynamic control data is stored in the bank 41*a*, the static control data is stored in the bank 41*b*, the dynamic control data is transferred from the bank 41*a* to a control device 40, and the static control data is transferred from the bank 41*b* to the control device 40. This avoids non-contiguous addresses during the data transfer, so as to facilitate the control of addresses while improving the efficiency of data transfer. Consequently, a large amount of dynamic control data and static control data can be transferred efficiently. As a result, there is no delay in response for the control operations in the image display device, allowing enhanced image display performance and increased added values of the image display device.

Moreover, the dynamic control data is transferred in each frame, and the static control data is transferred during the static process or the refresh process. Consequently, it is possible to reliably transfer the dynamic control data for the dynamic process to be accomplished for each frame within one frame period. It is also possible to reliably transfer, after the dynamic control data is transferred in one or a plurality of frames, the static control data for the static process or refresh process which are not required to be accomplished within each frame.

The image control block 42 and light source control block 43 may have any configurations and operations other than those illustrated in FIGS. 8 to 10, provided that they are designed to control the liquid crystal display panel 5 and light source 6 based on the dynamic control data or static control data.

(Other Modifications)

It is noted that, although in each of the image display devices according to the first and second embodiments above, data transfer in the static or refresh process is divided into three frames, data transfer may alternatively be divided into two frames or an arbitrary number of frames not less than four frames, depending on the amount of data. Where the static control data can be transferred after the dynamic control data is transferred within one frame, the static control data may be transferred within one frame without being divided into a plurality of frames.

Moreover, although in each of the first and second embodiments above, for the static or refresh process, the static control data is divided into the image control data 15*a*, light source control data 15*b*, and display mode control data 15*c* to be transferred in different frames, the image control data 15*a* and the light source control data 15*b* in portion may be transferred in one frame; i.e., different types of static control data may be mixed to be transferred within one frame.

It is noted that, although in each of the first and second embodiments above, description is provided of a case in which the present invention is applied to the image display device using the liquid crystal display panel 5, the present invention may similarly be applied to image display devices using other display panels, such as PDPs (Plasma Display Panel) or CRTs (Cathode Ray Tube).

In each of the first and second embodiments above, the dynamic process corresponds to a first process; the static process and refresh process correspond to second processes; the control device 40 corresponds to a control device; the decoder 41 corresponds to a storage device; the bank 41*a* corresponds to a first storage area; the bank 41*b* corresponds to a second storage area; the microcomputer 2 corresponds to a processor; the characteristic amount detector 3 corresponds to a characteristic amount detecting device; the controller 1 corresponds to a setting unit; the image control block, light source control block, and display mode control block correspond to control blocks; and the liquid crystal display panel 5 and light source 6 correspond to a display device.

The invention claimed is:

1. A display control device for controlling an image display device, comprising:

a controller configured to perform a first process for controlling said image display device in a cycle of one frame period and to perform a second process for controlling said image display device in a cycle different from one frame period and at an arbitrary timing;

a storage comprising a first storage area and a second storage area; and a processor configured to write first control data for said first process to said first storage area, to write second control data for said second process to said second storage area, to transfer said first control data stored in the first storage area to said controller in a cycle of one frame period, and to transfer said second control data stored in the second storage area to said controller in a cycle different from one frame period and at an arbitrary timing;

wherein said second process includes a static process for setting an operating state of said image display device based on a control signal supplied at an arbitrary timing and a refresh process for resetting the operating state set in the immediately preceding static process in the cycle different than the one frame period.

2. The display control device according to claim 1, wherein in a frame in which the first control data and the second control data are to be transferred, said processor transfers said first control data stored in the first storage area to said controller, and then transfers said second control data stored in the second storage area to said controller.

3. The display control device according to claim 2, wherein said processor distributes the second control data to a plurality of frames for transfer.

4. The display control device according to claim 1, wherein said first process includes a dynamic process for controlling an image displayed on a screen of said image display device based on a video signal.

5. The display control device according to claim 1, wherein said second process includes a static process for initializing an operating state of said image display device when power is applied to said image display device.

6. The display control device according to claim 1, further comprising a characteristic amount detector configured to detect the amount of characteristics of an image for one frame based on an input video signal, wherein said processor creates said first control data based on the amount of characteristics detected by said characteristic amount detector to write said first control data to said first storage area.

7. The display control device according to claim 1, further comprising a setter configured to set an operating state of said image display device, wherein said processor creates said second control data based on the operating state set by said setter to write said second control data to said second storage area.

8. The display control device according to claim 1, wherein said controller comprises a plurality of control blocks that perform at least one of said first process and second process, respectively, and said processor transfers at least one of the first and second control data stored in said first and second storage areas to each of the control blocks.

9. An image display device that displays an image, comprising:

a display having a screen that displays the image based on a video signal;

a controller configured to perform a first process for controlling said display in a cycle of one frame period while performing a second process for controlling said display in a cycle different from one frame period and at an arbitrary timing;

a storage comprising a first storage area and a second storage area; and a processor configured to write first control data for said first process to said first storage area, to write second control data for said second process to said second storage area, to transfer the first control data stored in said first storage area to said controller in a cycle of one frame period, and to transfer the second control data stored in said second storage area to said controller in a cycle different from one frame period and at an arbitrary timing wherein said second process includes a static process for setting an operating state of said image display device based on a control signal supplied at an arbitrary timing and a refresh process for resetting the operating state set in the immediately preceding process in the cycle different than the one frame period.

10. The image display device according to claim 9, wherein, in a frame in which the first control data and the second control data are to be transferred, said processor transfers said first control data stored in the first storage area to said controller, and then transfers said second control data stored in the second storage area to said controller.

11. The image display device according to claim 10, wherein said processor distributes the second control data to a plurality of frames for transfer.

12. The image display device according to claim 9, wherein said first process includes a dynamic process for controlling an image displayed on a screen of said image display device based on a video signal.

13. The image display device according to claim 9, wherein said second process includes a static process for initializing an operating state of said image display device when power is applied to said image display device.

14. The image display device according to claim 9, further comprising a setter configured to set an operating state of said image display device, wherein said processor creates said second control data based on the operating state set by said setter to write said second control data to said second storage area.

15. A method for transferring control data to a controller for controlling an image display device, the method comprising:

writing first control data for a first process for controlling the image display device in a cycle of one frame period to a first storage area;

writing second control data for a second process for controlling the image display device in a cycle different from one frame period and at an arbitrary timing to a second storage area;

transferring the first control data stored in the first storage area to the controller in a cycle of one frame period; and transferring the second control data stored in the second storage area to the controller in a cycle different from one frame period and at an arbitrary timing wherein the second process includes a static process for setting the operating state of the image display device based on a control signal supplied at an arbitrary timing and a refresh process for resetting the operating state set in the immediately preceding static process in the cycle different than the one frame period.

16. The method for transferring control data according to claim 15, wherein, in a frame in which the first control data and the second control data are to be transferred, said processor transfers said first control data stored in the first storage area to the controller, and then transfers said second control data stored in the second storage area to the controller.

17. The method for transferring control data according to claim 16, wherein the processor distributes the second control data to a plurality of frames for transfer.

18. The method for transferring control data according to claim 15, wherein the first process includes a dynamic process for controlling an image displayed on a screen of image display device based on a video signal.

19. The method for transferring control data according to claim 15, wherein the second process includes a static process for initializing an operating state of the image display device when power is applied to the image display device.

20. The method for transferring control data according to claim 15, further comprising setting an operating state of the image display device, and creating the second control data based on the set operating state, to write the second control data to the second storage area.

* * * * *

UNITED STATES PATENT AND TRADEMARK OFFICE

CERTIFICATE OF CORRECTION

PATENT NO. : 7,233,307 B2
APPLICATION NO. : 10/495113
DATED : June 19, 2007
INVENTOR(S) : Miura et al.

It is certified that error appears in the above-identified patent and that said Letters Patent is hereby corrected as shown below:

At column 14, lines 18-19(claim 1 line 17-18) of the printed patent, "at an arbitrary timing;" should be --at an arbitrary timing--.

Signed and Sealed this

Thirteenth Day of May, 2008

JON W. DUDAS
*Director of the United States Patent and Trademark Office*